US009931533B2

(12) United States Patent
Ingram

(10) Patent No.: US 9,931,533 B2
(45) **Date of Patent: *Apr. 3, 2018**

(54) LIFTING STRAP WITH ENHANCED GRIPPING PROPERTIES

(71) Applicant: Implus Footcare, LLC, Durham, NC (US)

(72) Inventor: Kenneth Robert Ingram, Kitchener (CA)

(73) Assignee: Implus Footcare, LLC, Durham, NC (US)

( * ) Notice: Subject to any disclaimer, the term of this patent is extended or adjusted under 35 U.S.C. 154(b) by 687 days.

This patent is subject to a terminal disclaimer.

(21) Appl. No.: 14/014,986

(22) Filed: Aug. 30, 2013

(65) Prior Publication Data

US 2014/0066272 A1 Mar. 6, 2014

Related U.S. Application Data

(63) Continuation of application No. 11/564,118, filed on Nov. 28, 2006, now Pat. No. 8,747,284.

(51) Int. Cl.

| | |
|---|---|
| ***A63B 23/16*** | (2006.01) |
| ***A63B 21/00*** | (2006.01) |
| *A63B 21/072* | (2006.01) |

(52) U.S. Cl.

CPC ..... *A63B 21/1442* (2013.01); *A63B 21/4001* (2015.10); *A63B 21/4021* (2015.10); *A63B 21/0724* (2013.01); *A63B 21/4017* (2015.10)

(58) Field of Classification Search

CPC ..... A63B 21/1434; A63B 21/1442; A63B 21/065; A63B 21/1403; A63B 21/072; A63B 21/1449; A63B 27/00; A63B 37/12; A63B 55/008; A41D 13/0015; A41D 13/082; A41D 13/088; A41D 2400/80; A41D 2400/82

USPC ..... 482/13, 44–50, 92–139, 34, 82; 2/161.1, 2/161.4, 20, 158, 162, 170; 441/68–69; 602/21, 64; 294/25; 128/879, 77, 133; D29/117.1

See application file for complete search history.

(56) References Cited

U.S. PATENT DOCUMENTS

| | | | | |
|---|---|---|---|---|
| 1,924,923 | A | 8/1933 | Gibbons | |
| 2,112,769 | A | 3/1938 | Getaz | |
| 3,175,559 | A | 3/1965 | Kane | |
| 3,498,410 | A | 3/1970 | Storch | |
| 3,712,689 | A | 1/1973 | Chaumont | |
| 3,774,242 | A | 11/1973 | Owen | |
| 3,893,604 | A * | 7/1975 | Skinner | 224/257 |
| 4,044,437 | A | 8/1977 | Ebenstein | |
| 4,052,095 | A | 10/1977 | Johnson | |
| 4,161,195 | A | 7/1979 | Khan | |
| 4,200,325 | A | 4/1980 | Johnson | |

(Continued)

FOREIGN PATENT DOCUMENTS

| | | | |
|---|---|---|---|
| CA | 2369757 | A1 | 8/2002 |
| WO | 2006076541 | A2 | 7/2006 |

*Primary Examiner* — Robert Long
(74) *Attorney, Agent, or Firm* — Edward S. Wright

(57) ABSTRACT

Weight lifting strap which is looped around the wrist and wrapped in helical fashion about a weight lifting bar or the like and gripped by the hand with opposite sides of the strap facing the bar and the hand, and the strap being fabricated of a woven material with rubberized strands on the side of the strap which faces the bar.

14 Claims, 4 Drawing Sheets

(56) References Cited

U.S. PATENT DOCUMENTS 4,400,831 A 8/1983 Rietz
4,430,990 A 2/1984 Whitehead
4,524,760 A 6/1985 Lerner
4,599,920 A 7/1986 Schmid
4,660,497 A 4/1987 Cochran
4,684,559 A 8/1987 Wasko
4,685,668 A 8/1987 Newlin, Jr.
4,775,345 A 10/1988 Gifford
4,793,005 A 12/1988 Hetzel, Jr.
4,809,974 A 3/1989 Buhr
4,834,439 A 5/1989 van de Kamp
4,843,651 A 7/1989 Gramza et al.
4,900,613 A 2/1990 Green
4,905,879 A * 3/1990 Piccone ..... 224/173
4,958,384 A 9/1990 McCrane
5,004,231 A 4/1991 Alread
5,070,866 A 12/1991 Alexander et al.
5,127,109 A 7/1992 Heitzman-Powell et al.
5,219,636 A 6/1993 Golz
5,238,279 A 8/1993 Anteau
5,272,796 A 12/1993 Nichols
5,292,328 A 3/1994 Hain et al.
5,324,244 A 6/1994 Miller et al.
5,350,343 A 9/1994 DaSilva
5,353,440 A 10/1994 Meldeau
5,362,295 A 11/1994 Nurge
5,388,743 A 2/1995 Silagy
5,419,951 A 5/1995 Golz
5,447,498 A 9/1995 Watson
5,472,000 A 12/1995 Olsen
5,500,952 A 3/1996 Keyes
5,551,447 A 9/1996 Hoffman et al.
5,553,324 A 9/1996 Emerson
5,557,805 A 9/1996 Emerson
5,557,806 A 9/1996 Caswell et al.
5,634,213 A 6/1997 Grover
5,688,011 A 11/1997 Gulley
5,732,662 A 3/1998 Jacobsen
5,737,773 A 4/1998 Dicker et al.
5,745,920 A 5/1998 Olivier
5,746,685 A 5/1998 Glaser
5,772,537 A 6/1998 Anderson et al.
5,804,307 A 9/1998 Wilhelm et al.
5,809,570 A 9/1998 Grover
5,813,950 A * 9/1998 Parker ..... 482/93
5,888,180 A 3/1999 Dewberry
5,894,976 A 4/1999 Harper
5,898,944 A 5/1999 Vrany
5,927,297 A 7/1999 Cooper
5,994,612 A 11/1999 Watkins
6,076,874 A * 6/2000 Lovette ..... 294/87.2
6,138,285 A 10/2000 Robrahn et al.
6,146,319 A 11/2000 Tarail
6,149,215 A 11/2000 Balogh et al.
6,168,556 B1 1/2001 Saavedra
6,194,629 B1 2/2001 Bernhard
6,216,636 B1 4/2001 Butchko
6,223,565 B1 * 5/2001 Cooper ..... 66/172 E
6,231,488 B1 5/2001 Dicker et al.
6,298,488 B1 10/2001 Duncan et al.
D459,772 S 7/2002 Meldeau
D464,686 S 10/2002 Silveira et al.
6,553,574 B1 4/2003 Hall, Jr. et al.
6,564,385 B2 5/2003 McCarthy
6,626,335 B1 9/2003 Dunlop
6,687,916 B2 2/2004 Thompson
6,704,939 B2 3/2004 Faulconer
6,736,263 B1 5/2004 Smith
6,834,397 B1 12/2004 Murphy
6,895,601 B2 5/2005 Park
6,898,802 B1 5/2005 Suarkeo
6,929,615 B2 * 8/2005 Derr ..... 602/20
6,990,689 B1 1/2006 Thellmann
7,004,889 B2 * 2/2006 McBride ..... 482/92
7,008,355 B2 3/2006 Emick
7,041,032 B1 5/2006 Calvano
7,043,762 B2 5/2006 Greenhalgh
D525,323 S 7/2006 Dwars
7,096,544 B2 * 8/2006 Lusardi ..... 24/306
7,118,516 B1 10/2006 Gouthro
7,275,729 B2 10/2007 Sherman et al.
7,419,198 B2 9/2008 Baker et al.
7,490,634 B2 2/2009 Resendez et al.
7,520,074 B1 * 4/2009 Vanova ..... 40/586
2003/0119632 A1 6/2003 Archuleta
2004/0209534 A1 10/2004 Graham
2004/0262080 A1 12/2004 Reynolds et al.
2005/0039242 A1 * 2/2005 Edmondson ..... 2/207
2005/0075227 A1 4/2005 Emick
2005/0204501 A1 9/2005 Golec
2005/0274753 A1 * 12/2005 Swentor et al. ..... 224/148.6
2005/0277491 A1 12/2005 Nolan
2006/0081748 A1 4/2006 Sherman et al.
2006/0081749 A1 4/2006 Sherman et al.
2006/0157077 A1 7/2006 Kraft et al.
2006/0186150 A1 8/2006 Willows et al.
2006/0255214 A1 11/2006 Simone
2007/0118966 A1 5/2007 Beraznik
2007/0197859 A1 8/2007 Schaer et al.
2007/0267084 A1 * 11/2007 Pereira et al. ..... 139/116.1
2008/0009398 A1 1/2008 Grisdale
2008/0085817 A1 4/2008 Brentlinger et al.
2008/0090705 A1 4/2008 Wang
2008/0120755 A1 5/2008 Ingram et al.
2009/0090378 A1 4/2009 Chudzik et al.
2009/0162651 A1 6/2009 Rios et al.
2009/0275448 A1 * 11/2009 Fishman ..... 482/139
2011/0047670 A1 * 3/2011 Anderson ..... 2/161.1
2011/0048071 A1 * 3/2011 Campbell ..... 63/3.1
2012/0102619 A1 * 5/2012 Parsons et al. ..... 2/163
2013/0262298 A1 * 10/2013 Morley ..... 705/39

* cited by examiner

LIFTING STRAP WITH ENHANCED GRIPPING PROPERTIES

RELATED APPLICATION

Continuation of Ser. No. 11/564,118, filed Nov. 28, 2006.

BACKGROUND OF THE INVENTION

Field of Invention

This invention pertains generally to weight lifting and fitness equipment and, more particularly, to a strap for improving the grip on such equipment.

Related Art

Lifting straps are used as an aid in weight lifting and fitness exercises to improve the user's grip on a bar and to allow him to concentrate on the muscles he wants to exercise rather than the ones which would otherwise be used in gripping the bar. The strap is typically looped about the wrist and then wrapped about the bar where it is gripped by the hand. Examples of such straps are found in U.S. Pat. Nos. 4,809,974, 5,324,254, 5,745,920 and 7,004,889.

OBJECTS AND SUMMARY OF THE INVENTION

It is in general an object of the invention to provide a new and improved strap for use in weight lifting and the like.

Another object of the invention is to provide a lifting strap of the above character which overcomes the limitations and disadvantages of the prior art.

These and other objects are achieved in accordance with the invention by providing a weight lifting strap which is wrapped in helical fashion about a bar and gripped by a hand with opposite sides of the strap facing the bar and the hand, and the strap being fabricated of a woven material with rubberized strands on the side of the strap which faces the bar.

DETAILED DESCRIPTION

Figure 1:
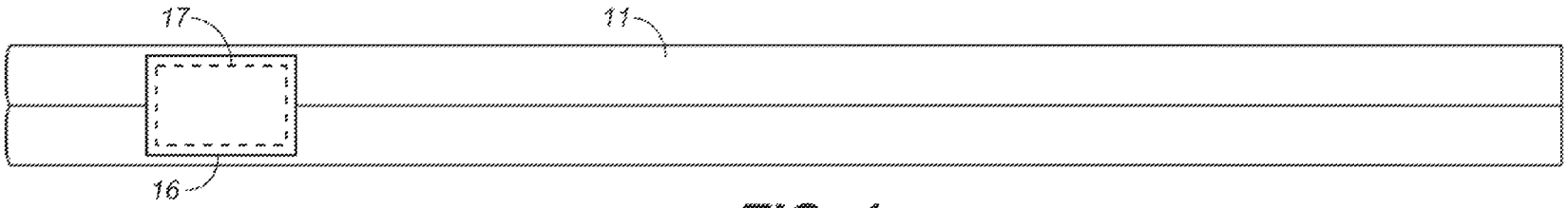
FIGS. 1 and 2 are front and rear elevational views of one embodiment of a lifting strap according to the invention.

As illustrated in the drawings, lifting strap 11 is woven of a durable, flexible material such as nylon, with strands 12 of a rubberized material in the weave on the back side of the strap. At one end of the strap, the end portion 13 is folded back upon itself and stitched to form a loop 14, with the rubberized strands on the inner side of the loop. A label 16 is affixed to the front side of the strap near the loop and, in the embodiment illustrated, is secured to the strap by the same stitches 17 that form the loop.

Figure 4:
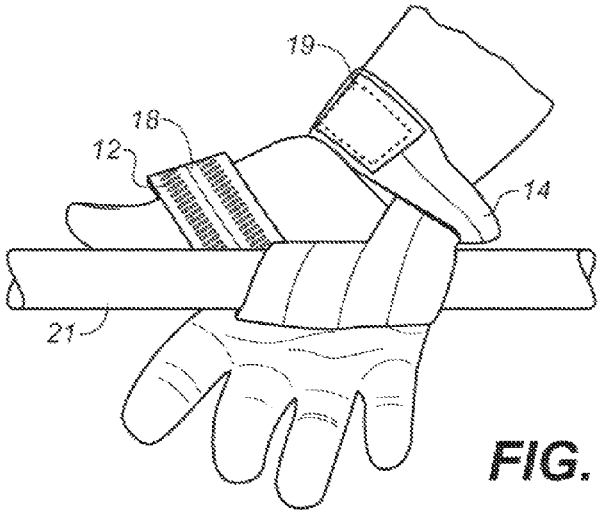
FIG. 4 is an isometric view illustrating use of the embodiment of FIGS. 1 and 2.
Figure 5:
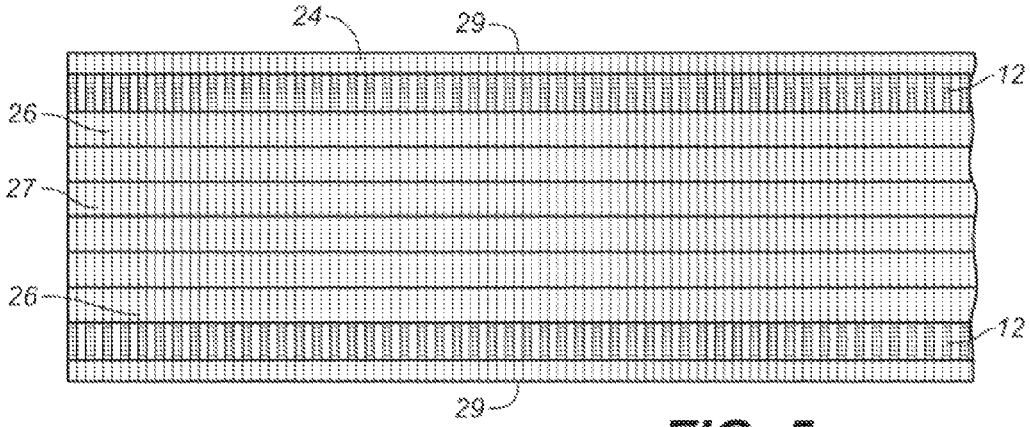
FIG. 5 is a fragmentary plan view of a web of woven material from which the embodiment of FIGS. 1 and 2 is made.
Figure 6:
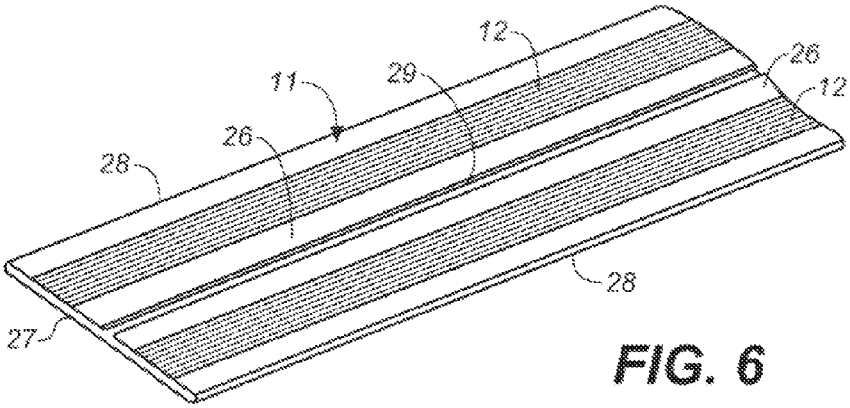
FIG. 6 is a fragmentary isometric view of the web of FIG. 5 being folded to form the embodiment of FIGS. 1 and 2.

The strap typically has a length on the order of 20-22 inches and a width on the order of 1.5 inches. As illustrated in FIG. 4, it is looped about the wrist of a user by passing the free end 18 of the strap through loop 14 to form a larger loop 19 which encircles the wrist, with the free portion of the strap being wrapped in helical fashion about a weight lifting bar 21, or the like, with the rubberized strands 12 facing the bar.

The rubberized strands extend lengthwise of the strap and provide enhanced gripping properties for the side of the strap which faces the object be gripped. In the embodiment illustrated, the rubberized strands are arranged in two groups 22 of eight strands each, and the two groups are disposed side-by-side and spaced laterally apart along the strap.

Figure 2:
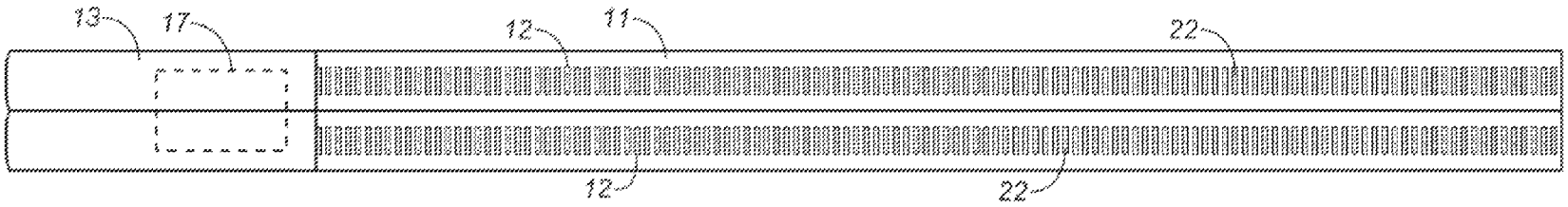
Figure 3:
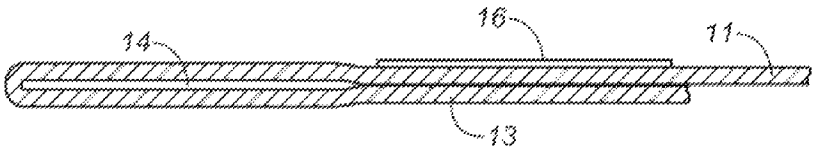
FIG. 3 is a fragmentary side elevational view of the embodiment of FIGS. 1 and 2.

In the embodiment of FIGS. 1 and 2, the strap is made from a web 24 of woven fabric which is approximately twice as wide as the finished strap, with the two groups of rubberized strands 12 in lateral edge portions 26 of the web. The edge portions are approximately one-fourth as wide as the web and half as wide as the finished strap, and they are folded over the central portion 27 of the web along longitudinally extending fold lines 28, with the selvedge edges 29 of the web coming together near the longitudinal centerline of the strap. The folded-over edge portions are secured to the central portion by suitable means such as over-weaving or stitching to form a substantially flat two layer strap, with the central portion of the web serving as a base for the layer with the rubberized strands.

Once the two layer structure has been formed, it is cut into lengths for the individual straps, and the raw ends of the individual straps are stitched to prevent them from fraying. One end portion of each strap is then folded over and stitched to itself to form loop 14 and to secure label 16 to the strap.

Figure 7:
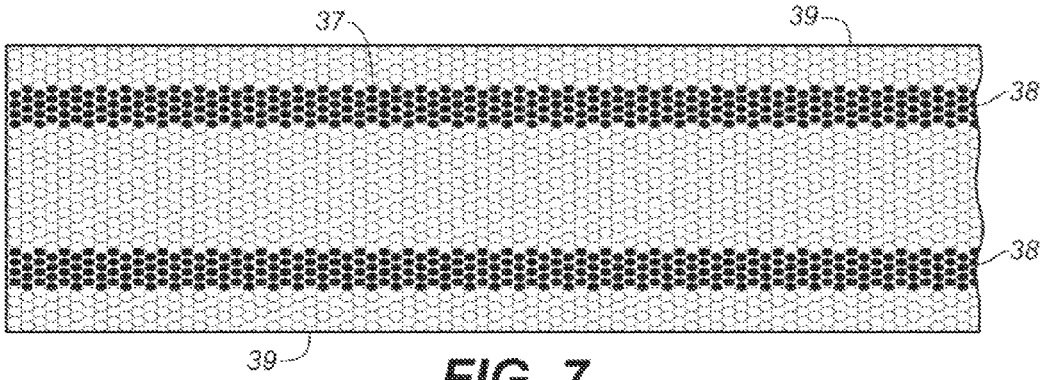
FIGS. 7 and 8 are top and bottom plan views of another embodiment of a woven material for use in a lifting strap according to the invention.
Figure 8:
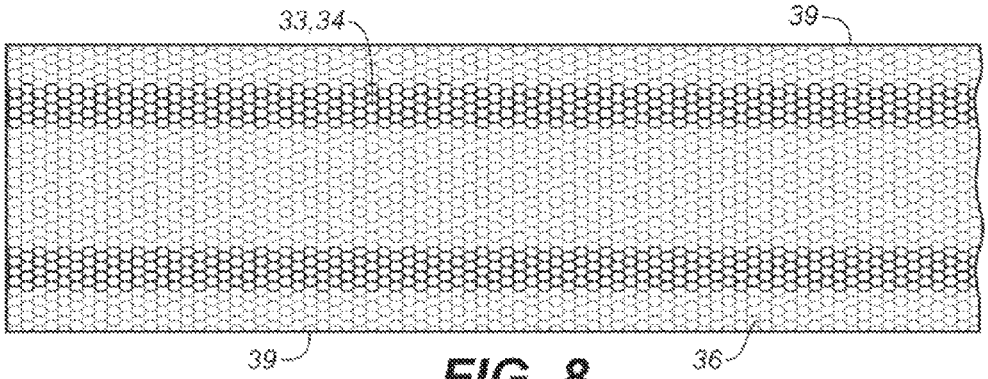
Figure 9:
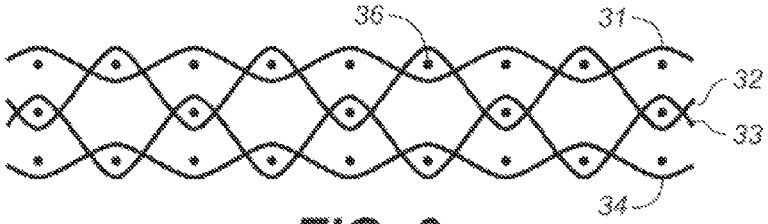
FIGS. 9 and 10 are fragmentary cross-sectional views of the embodiment of FIGS. 7 and 8.
Figure 10:
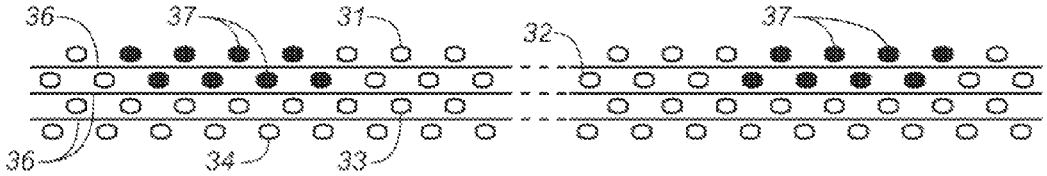

In the embodiment of FIGS. 7 and 8, the material is a flat, multi-layer woven fabric with rubberized strands in the top layer only. In this material, four layers of warp strands 31, 32, 33, 34 are woven together in an over-under pattern with a weft strand 36 which is common to all of the layers. As best seen in FIG. 9, the two uppermost layers 31, 32 are woven together, as are the two lowermost layers 33, 34. Inner layers 32, 33 are also woven together to form an interlocking structure. Rubberized strands 37 are included in the top layer of warp strands and are woven only with the strands in the second layer. Hence, the rubberized strands are confined to the top layer of the weave and do not go all the way through the material.

In this embodiment rubberized strands 37 are arranged in two groups 38, 38 of eight strands each near the edges 39 of the material.

When formed into a lifting strap, the flat interwoven fabric is positioned with the rubberized strands on the back side of the strap. Then, as described above, one end portion of the strap is folded back upon itself and stitched to form a loop, with the rubberized strands on the inner side of the loop, and a label is affixed to the front side of the strap near the loop. This strap is used in the same manner as the embodiment of FIGS. 1 and 2.

Figure 11:
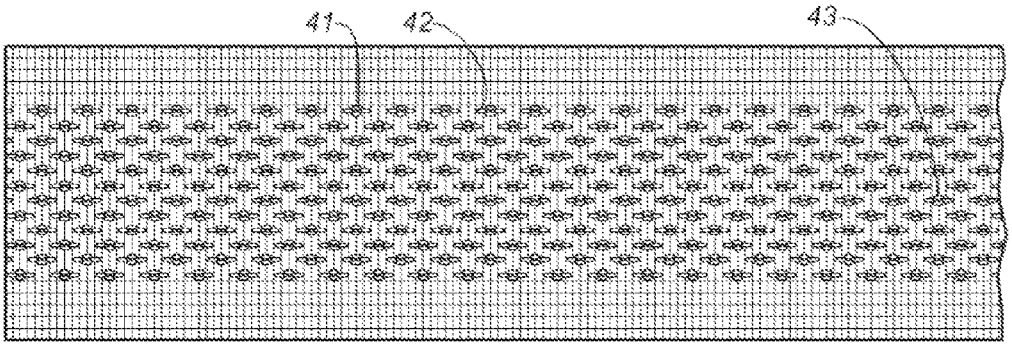
FIGS. 11 and 12 are top and bottom plan views of another embodiment of a woven material for use in a lifting strap according to the invention.
Figure 12:
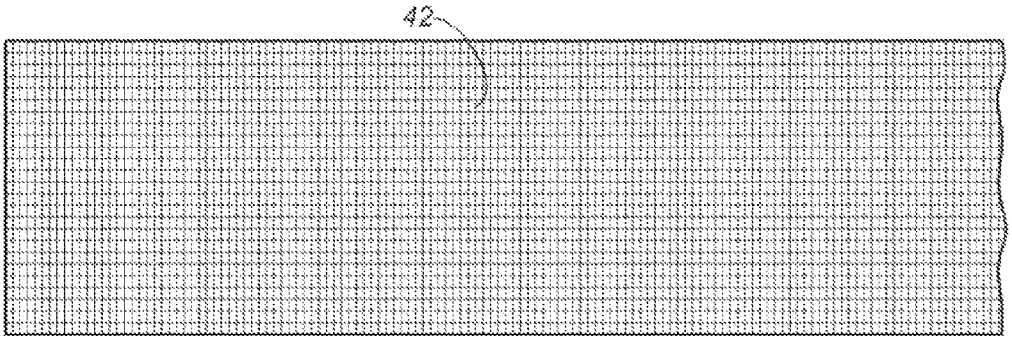

The embodiment of FIGS. 11 and 12 is similar to the embodiment of FIGS. 7 and 8 except for the number and the location of the rubberized warp strands in the upper layer of the fabric. In this embodiment, the rubberized strands 41 are arranged in groups of three, with non-rubberized strands 42 between the groups, and woven into a diamond shaped pattern in the central portion 43 of the fabric. This material is used in the same manner as the embodiment of FIGS. 7 and 8 in making a strap, with the rubberized strands on the back side of the strap for engagement with the bar or object to be lifted.

The invention has a number of important features and advantages. The rubberized strands facing the bar provide enhanced gripping properties with better control and greater safety in the lifting of heavier weights.

It is apparent from the foregoing that a new and improved lifting strap has been provided. While only certain presently preferred embodiments have been described in detail, as will be apparent to those familiar with the art, certain changes and modifications can be made without departing from the scope of the invention as defined by the following claims.

The invention claimed is:

1. A weight lifting strap wrapped in helical fashion about a bar and gripped by a hand with opposite sides of the strap facing the bar and the hand, the strap being fabricated of a woven material with rubberized strands woven into the material on the side which faces the bar but not on the side which faces the hand.

2. The weight lifting strap of claim 1 wherein the woven material is nylon.

3. The weight lifting strap of claim 1 wherein the rubberized strands extend lengthwise of the strap.

4. The weight lifting strap of claim 1 wherein the rubberized strands are arranged in two groups disposed toward opposite edges of the strap.

5. The weight lifting strap of claim 1 wherein one end portion of the strap is folded back upon itself to form a loop with the rubberized strands on the inner side of the loop.

6. The weight lifting strap of claim 5 including a label affixed to the strap near the loop and on the side of the strap without the rubberized strands.

7. The weight lifting strap of claim 1 wherein the strap has two superposed layers, with the rubberized strands being woven into only one of the layers.

8. Weight lifting apparatus, comprising an elongated strap wrapped in helical fashion about a bar with opposite sides of the strap facing toward the bar and away from the bar, the strap being fabricated of a woven material with rubberized strands woven into the material on the side facing toward the bar but not on the side facing away from the bar.

9. The weight lifting apparatus of claim 8 wherein the woven material is nylon.

10. The weight lifting apparatus of claim 8 wherein the rubberized strands extend lengthwise of the strap.

11. The weight lifting apparatus of claim 8 wherein the rubberized strands are arranged in two groups disposed toward opposite edges of the strap.

12. The weight lifting apparatus of claim 8 wherein one end portion of the strap is folded back upon itself to form a loop with the rubberized strands on the inner side of the loop.

13. The weight lifting apparatus of claim 12 including a label affixed to the strap near the loop and on the side of the strap without the rubberized strands.

14. The weight lifting apparatus of claim 8 wherein the strap has two superposed layers, with the rubberized strands being woven into only one of the layers.

* * * * *